US007980077B2

(12) United States Patent
Johnson

(10) Patent No.: US 7,980,077 B2
(45) Date of Patent: Jul. 19, 2011

(54) COOLING SYSTEM KIT, METHOD TO RETROFIT, AND METHOD TO OPERATE A TURBOCHARGED ENGINE SYSTEM

(75) Inventor: Andrew M. Johnson, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 152 days.

(21) Appl. No.: 12/474,989

(22) Filed: May 29, 2009

(65) Prior Publication Data

US 2010/0299923 A1 Dec. 2, 2010

(51) Int. Cl.

| | |
|---|---|
| ***F02B 29/04*** | (2006.01) |
| ***F02B 33/00*** | (2006.01) |
| ***F01P 7/14*** | (2006.01) |
| ***F01P 5/10*** | (2006.01) |
| ***G06F 17/50*** | (2006.01) |

(52) U.S. Cl. ..... 60/599; 123/563; 123/41.1; 123/41.44; 703/1

(58) Field of Classification Search ..... 60/599; 123/563, 41.29, 41.31, 41.33, 41.4, 41, 41.44; 703/1

See application file for complete search history.

(56) References Cited

U.S. PATENT DOCUMENTS

| | | | | |
|---|---|---|---|---|
| 4,325,219 | A | 4/1982 | Stang et al. | 60/599 |
| 4,620,509 | A | 11/1986 | Crofts | 123/41.1 |
| 5,201,285 | A | 4/1993 | McTaggart | 123/41.31 |
| 5,353,757 | A * | 10/1994 | Susa et al. | 123/563 |
| 5,415,147 | A | 5/1995 | Nagle et al. | 60/599 |
| 5,669,338 | A | 9/1997 | Pribble et al. | 60/599 |
| 5,910,099 | A * | 6/1999 | Jordan et al. | 60/599 |
| 6,006,731 | A * | 12/1999 | Uzkan | 123/563 |
| 6,098,576 | A | 8/2000 | Nowak, Jr. et al. | 123/41.33 |
| 6,230,668 | B1 * | 5/2001 | Marsh et al. | 123/41.44 |
| 6,499,298 | B2 | 12/2002 | Uzkan | 60/599 |
| 7,040,303 | B2 | 5/2006 | Uzkan et al. | 60/599 |
| 7,059,278 | B2 * | 6/2006 | Hedrick et al. | 60/599 |
| 7,131,403 | B1 | 11/2006 | Banga et al. | 123/41.31 |
| 7,168,398 | B2 * | 1/2007 | Ap et al. | 123/41.1 |
| 7,533,636 | B2 * | 5/2009 | Marsh et al. | 123/41.33 |
| 7,717,069 | B2 * | 5/2010 | Mokire et al. | 60/599 |
| 2005/0193963 | A1 * | 9/2005 | Hedrick et al. | 60/599 |
| 2007/0038414 | A1 * | 2/2007 | Rasmussen et al. | 703/1 |
| 2007/0078635 | A1 * | 4/2007 | Rasmussen et al. | 703/1 |
| 2007/0135032 | A1 * | 6/2007 | Wang | 454/184 |

FOREIGN PATENT DOCUMENTS

DE 3517567 A1 * 12/1985

* cited by examiner

*Primary Examiner* — Thai Ba Trieu

(74) *Attorney, Agent, or Firm* — Robert Wawrzyn; Alleman Hall McCoy Russell & Tuttle LLP

(57) ABSTRACT

A method for retrofitting a cooling system of a turbocharged engine system. The method comprises reconfiguring the cooling system so that at least some coolant flows from a first radiator to a second radiator, and from the second radiator to an inlet of an intercooler without first passing through a lubricant cooler. The method may be applied to a cooling system originally configured so that at least some of the coolant would flow through the first and second radiators in parallel, and from the first and second radiators to the lubricant cooler, before flowing to the inlet of the intercooler.

20 Claims, 6 Drawing Sheets

COOLING SYSTEM KIT, METHOD TO RETROFIT, AND METHOD TO OPERATE A TURBOCHARGED ENGINE SYSTEM

TECHNICAL FIELD

The present application relates to the field of turbocharged engine systems, and more particularly to cooling systems of turbocharged engine systems.

BACKGROUND

A locomotive may be powered by one or more engines that maintain a suitable operating temperature by releasing excess heat to ambient air. The heat may be conducted away from the one or more engines via a recirculating coolant, e.g., water, and dissipated into the ambient air via one or more radiators. The coolant may draw heat from various engine components or systems, which include lubricant coolers, cylinder jackets, and/or charge-air intercoolers. The rate of cooling provided to each of the engine components partly controls their operating temperatures, which in turn may affect engine performance and emissions.

In particular, the level of nitrogen oxide (NOX) emissions from a diesel engine may be linked to manifold air temperature, with lower manifold air temperatures enabling lower emissions. In turbocharged diesel-engine systems, therefore, providing coolant of a relatively low temperature to the charge-air intercoolers may improve emissions. Further, providing coolant of a somewhat higher temperature to lubricant coolers and cylinder jackets may help to avoid overcooling the engine and thereby improve operation.

Accordingly, U.S. Pat. Nos. 4,620,509 and 5,669,338 provide a common radiator package with separate water circuits flowing to a charge-air intercooler and to a lubricant cooler. Further, U.S. Pat. Nos. 5,201,285, 5,415,147, 6,098,576, and 7,131,403 provide a single-pass radiator in series with a two-pass subcooler. This approach—sometimes referred to as 'split cooling'—has been implemented in locomotives made by General Electric Company—the Dash 9, AC4400, AC6000, ES44AC, ES44DC, and ES59-ACi (China Mainline), for example. Other approaches are outlined in U.S. Pat. No. 6,499,298, where a charge-air intercooler receives a lower-temperature coolant flow than other cooled engine components.

The inventors herein have identified a limitation common to each of the approaches cited above. These solutions, while suitable for reducing NOX emissions in newly manufactured locomotives, may be expensive to apply as a retrofit to pre-existing locomotives, including the General Electric Dash 7 and Dash 8 models. Moreover, the solutions cited above may be prohibitive in terms of the space required to implement them. In particular, retrofitting an existing locomotive according to the specifications of the cited art may require installation of new and differently configured radiators, and in some cases, a new coolant tank to support a second cooling circuit. In addition, new radiator fans, an additional coolant pump, and thermal control valves may all be required to effect the foregoing solutions on the Dash 7 or Dash 8.

Still other approaches, such as described in U.S. Pat. No. 4,325,219, use separate radiators for the charge-air intercoolers and for the lubricant cooler. This configuration also may not be suitable for the Dash 7 and Dash 8 models (for example) because it would reduce available power at high ambient temperatures if applied as a retrofit.

BRIEF DESCRIPTION

Therefore, in one embodiment, a method for retrofitting a cooling system of a turbocharged engine system is provided.

The method comprises reconfiguring the cooling system so that at least some coolant flows from a first radiator to a second radiator, and from the second radiator to an inlet of an intercooler without first passing through a lubricant cooler. The method may be applied to a cooling system originally configured to flow at least some of the coolant through the first and second radiators in parallel, and from the first and second radiators to the lubricant cooler, before flowing to the inlet of the intercooler.

Another embodiment provides a kit for retrofitting a cooling system of a turbocharged engine system. The kit comprises a plumbing patch configured to couple to the cooling system, the plumbing patch comprising: a first plumbing segment configured to couple an outlet of an intercooler to an inlet of a coolant pump, a second plumbing segment configured to couple a cylinder jacket to first and second banks of radiators, and a third plumbing segment configured to couple the second bank of radiators to an inlet of the intercooler, to a flow-through coolant tank, and to an outlet of the coolant pump. In this embodiment, the third plumbing segment includes at least one control valve operatively coupled to an electronic control system. The kit may also include media embodying human-readable instructions that specify how to install the plumbing patch.

Another embodiment provides a method for operating a modified cooling system of a turbocharged engine system. The method comprises operating the cooling system in a first operating mode when a lubricant temperature is below a threshold, and in a second operating mode when the lubricant temperature is above the threshold. In the example method, operating the cooling system in the first operating mode includes directing the coolant from a bank of radiators to an inlet of an intercooler; operating the cooling system in the second operating mode includes directing the coolant from the bank of radiators to a flow-through coolant tank and from an outlet of a coolant pump to the inlet of the intercooler.

According to these embodiments and others described herein, a turbocharged engine system may be retrofit for reduced NOX emissions in a cost-effective manner, e.g., without replacing the more expensive components of the original cooling system.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

BRIEF DESCRIPTION OF THE FIGURES

The present invention will be better understood from reading the following description of non-limiting embodiments, with reference to the attached drawings, wherein below.

DETAILED DESCRIPTION

Figure 1:
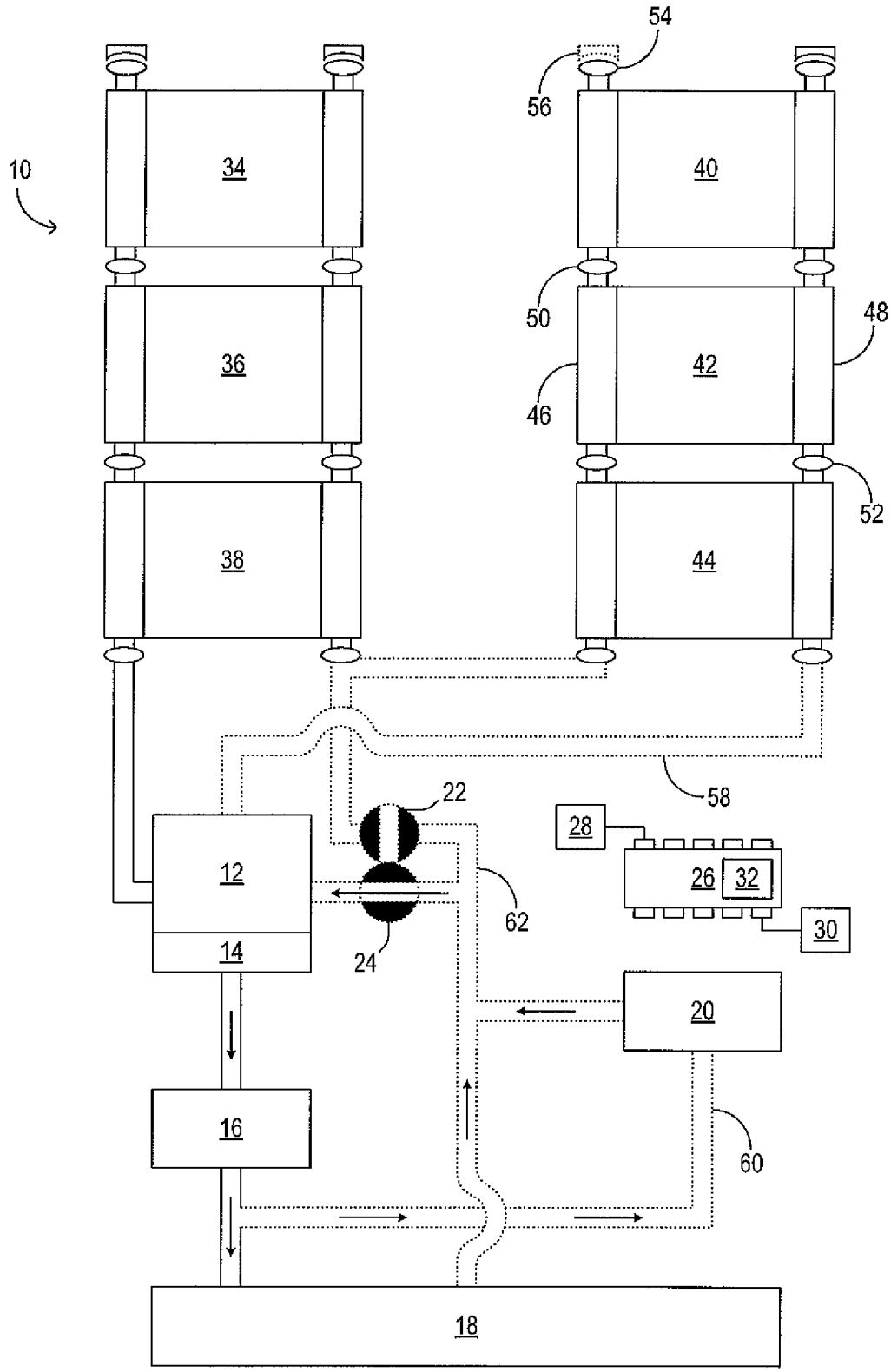
FIG. 1 shows aspects of an example original cooling system operating at a lower level of cooling, in accordance with the present disclosure.
Figure 2:
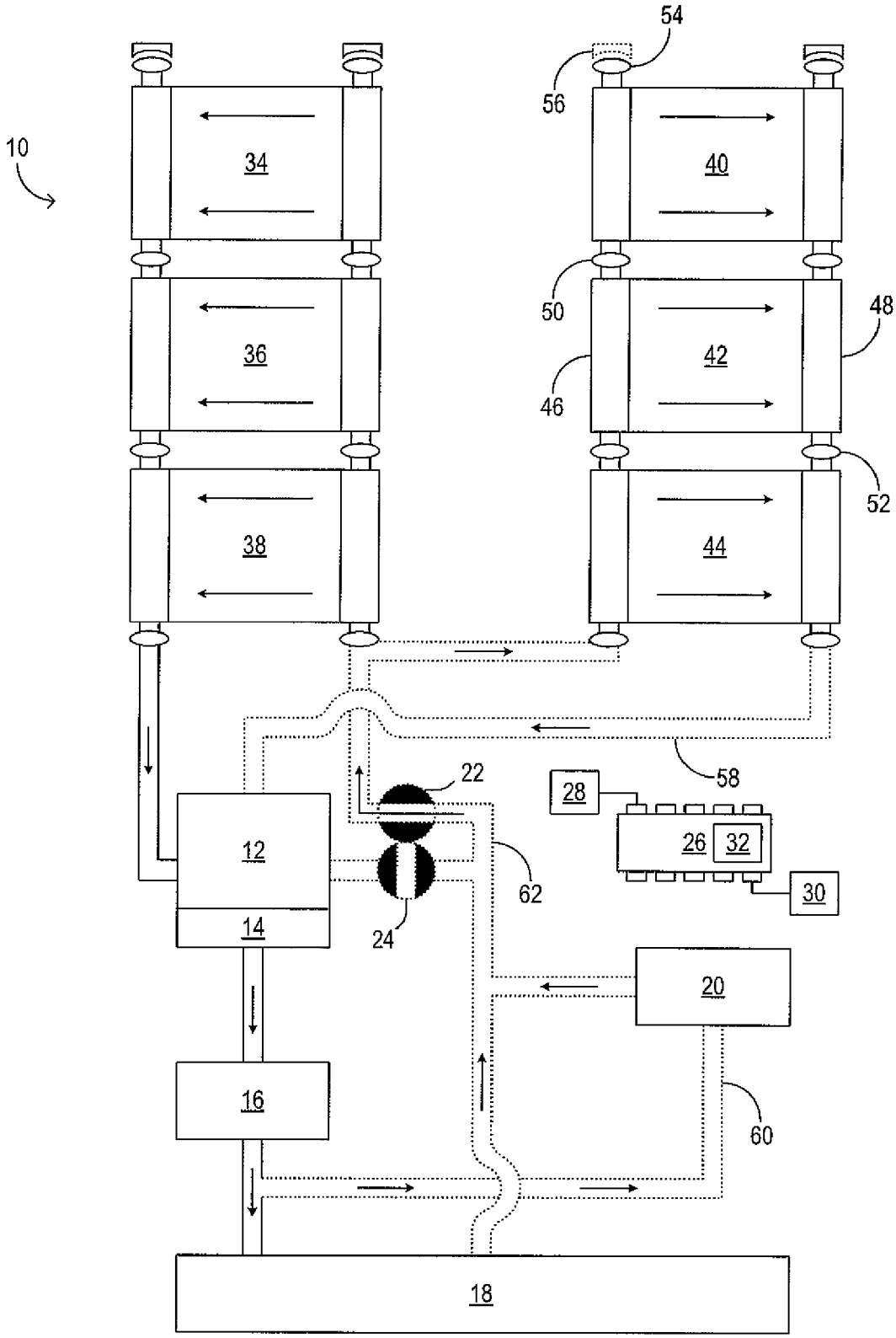
FIG. 2 shows aspects of an example original cooling system operating at a higher level of cooling, in accordance with the present disclosure.

FIGS. 1 and 2 schematically show aspects of an original cooling system 10 of a turbocharged engine system in one example configuration. The original cooling system may be disposed in an existing, in-service locomotive as original equipment.

Original cooling system 10 is configured to circulate a coolant (e.g., water) through one or more closed coolant loops; it includes flow-through coolant tank 12 coupled to lubricant cooler 14. The flow-through coolant tank may be any suitable reservoir for the coolant. The lubricant cooler may be any suitable heat exchanger configured to conduct the coolant and an engine lubricant (e.g. lubricant oil) in separate flow paths and to promote the transfer of heat therebetween.

In the illustrated configuration, coolant from flow-through coolant tank 12 passes through lubricant cooler 14, where it cools the engine lubricant, and advances to an inlet of coolant pump 16. The coolant pump may be any suitable pump configured to pressurize the coolant and force it through the various cooling circuits of original cooling system 10. In particular, the coolant pump is configured to force the coolant through one or more cylinder jackets 18 and one or more charge-air intercoolers 20. Although represented in the drawings as a single box, the charge-air intercoolers may comprise a plurality of air-coolant heat exchangers coupled to one or more turbocharger compressors and to one or more intake manifolds of the turbocharged engine system. From the cylinder jackets and charge-air intercoolers, the coolant flows to control valves 22 and 24.

Control valves 22 and 24 are fluidically independent butterfly valves maintained in registry with each other via a common shaft, or otherwise actuated in common. They may be controlled by a common pneumatic and/or electronic valve actuator, operatively coupled to an electronic control system of original cooling system 10 or of the turbocharged engine system in which the original cooling system is installed. Accordingly, FIGS. 1 and 2 show electronic control system 26, operatively coupled to one or more electronically controlled valve actuators 28, and one or more sensors 30. In some configurations, the electronically controlled valve actuators may operate via an intermediate hydraulic or pneumatic agent supplying motive force to the control valves. The one or more sensors may comprise a lubricant temperature sensor, a coolant temperature sensor, a lubricant pressure sensor, a manifold air temperature sensor, and/or an ambient temperature sensor—as examples.

Electronic control system 26 includes at least one memory 32 adapted to store machine-readable instructions. According to the instructions stored in the memory, the electronic control system enacts the various control functions described herein. The positions of control valves 22 and 24 may at least partly control whether original cooling system 10 provides a lower level of cooling or a higher level of cooling, as further described hereinafter. In particular, the positions of the control valves may determine whether one or more radiators are included in the coolant circuit. The cooling level enacted at a given time may be selected automatically by the electronic control system based on one or more operating conditions of the turbocharged engine system—coolant temperature, manifold air temperature, ambient temperature, engine load, as examples.

FIGS. 1 and 2 show two banks of radiators: a first bank disposed on the A-side of the locomotive, comprising A-side radiators 34, 36, and 38, and a second bank disposed on the B-side of the locomotive, comprising B-side radiators 40, 42, and 44. It will be understood that 'A-side' and 'B-side' are terms of art used in locomotive manufacturing. When the locomotive is viewed from the front, the A-side is the right side of the locomotive, and the B-side is the left side. Further, in most locomotives in service in North America, the A-side is the same as the 'operator side.' Each of the A-side and B-side radiators is a coolant-air heat exchanger in which the flow of heat from the coolant to the ambient air is assisted by forced convection of the ambient air. Accordingly, the A-side radiators and B-side radiators may include one or more air impellers (e.g., fans, not shown in the drawings). The air impellers may be configured to provide a substantially equal air flow to each of the A-side and B-side radiators. In some configurations, each of the A-side and B-side radiators may be a single-pass water-to-air heat exchanger having independent, interior-facing and exterior-facing header tanks. Thus, FIGS. 1 and 2 show interior-facing header tank 46 and exterior-facing header tank 48 of B-side radiator 42. In some configurations, each of the A-side radiators and each of the B-side radiators may have interior-facing and exterior-facing header tanks as shown for B-side radiator 42.

In some configurations, each of the A-side and B-side radiators may be slightly canted with respect to the locomotive chassis, such that the exterior-facing header tank descends lower than the interior-facing header tank. This orientation allows the coolant in the radiators to drain into flow-through coolant tank 12 when the engine is shut down or when the original cooling system 10 is switched from a higher level of cooling to a lower level of cooling.

In the illustrated configuration, coolant is conducted into and out of each of the A-side and B-side radiators via one or more clamp-type couplings configured to join two segments of pipe. In one, non-limiting embodiment, the clamp-type couplings referred to herein may be those manufactured by Victaulic Corporation of Easton, Pa. Accordingly, FIGS. 1 and 2 show clamp-type couplings 50 and 52 coupled to B-side radiator 42 and adjacent B-side radiators. Clamp-type couplings are shown in original cooling system 10 in various other locations as well. (Each clamp-type coupling is represented in the drawings using the same symbol, but not all of the clamp-type couplings are assigned reference numerals.) In particular, FIGS. 1 and 2 show clamp-type coupling 54 coupled to B-side radiator 40, and end cap 56 coupled to the clamp-type coupling. This structure may be used to prevent coolant from flowing out of the radiator through clamp-type coupling 54 while preserving the modularity of the radiator configuration. End caps are shown coupled to various other couplings of the original cooling system as well. (Each end cap is represented in the drawings using the same symbol, but not all of the end caps are assigned reference numerals.)

FIG. 1 shows original cooling system 10 operating at a lower level of cooling. Under these conditions, coolant from cylinder jackets 18 and charge-air intercoolers 20 flows through control valve 24 to flow-through coolant tank 12, by-passing the A-side and B-side radiators.

FIG. 2 shows original cooling system 10 operating at a higher level of cooling. Under these conditions, hot coolant from cylinder jackets 18 and charge-air intercoolers 20 flows through control valve 22 to A-side radiators 34, 36, and 38, and to B-side radiators 40, 42, and 44. From both the A-side and B-side radiators, coolant flows back to flow-through coolant tank 12. From the flow-through coolant tank, the coolant enters lubricant cooler 14 and cools the engine lubricant. The coolant then enters an inlet of coolant pump 16, and is pumped through cylinder jackets 18, and, in parallel, charge-air intercoolers 20.

A limitation of the original cooling system described above is that the coolant provided to charge-air intercoolers 20 may be constrained to the same temperature range as the coolant provided to the cylinder jackets 18 and lubricant cooler 14, which are typically maintained above 180° F. (approximately 82° C.). However, increased cooling to the charge-air intercoolers may be desirable for providing lower manifold air temperature and lower NOX emissions.

Therefore, a retrofit solution is provided herein, which transforms original cooling system 10 to a modified cooling system suitable for providing a lower manifold air temperature and lower NOX emissions. The retrofit may enable a 29° F. (16° C.) reduction in manifold air temperature under most conditions without requiring a corresponding reduction in engine coolant inlet temperatures. Further, the retrofit may enable a 9° F. (5° C.) reduction in the cooling control setpoint for the air impellers coupled to the A-side and B-side radiators, thereby enabling a lower coolant pump inlet temperature, resulting in a total reduction of charged air temperature of 38° F. Further still, the retrofit allows the reuse of most original cooling system components, requiring only a partial rerouting of the coolant circuits, an addition of relatively inexpensive hardware, and a modification of the original cooling system control software.

As noted above, the presently disclosed retrofit solution comprises, in one embodiment, removing some components from original cooling system 10 and installing other components to yield a modified cooling system. In this embodiment, the components removed include end cap 56 and plumbing segments 58, 60, and 62, which are shown in dashed lines in FIGS. 1 and 2. Plumbing segment 58 couples the exterior-facing header tank of B-side radiator 44 to flow-through coolant tank 12; plumbing segment 60 couples the outlet of coolant pump 16 to the inlet of charge-air intercoolers 20; and plumbing segment 62 couples the outlet of cylinder jackets 18 to the outlet of the charge-air intercoolers, to the interior-facing header tanks of A-side radiator 38 and B-side radiator 44, and to an inlet of flow-through coolant tank 12.

The components added to an original cooling system to enact the retrofit are referred to herein as a 'plumbing patch.' These components are now described with reference to modified cooling system 64, shown in FIGS. 3 and 4 in one example embodiment. The components added to original cooling system 10 to enact the retrofit include end cap 66, blocking plate 68, venting plate 70, and plumbing segments 72, 74, and 76—shown cross-hatched in FIGS. 3 and 4.

Blocking plate 68 may be any suitable flow stop disposed in the coolant conduit linking the interior-facing header tanks of B-side radiators 40 and 42. Accordingly, the blocking plate may be a circular plate having the same diameter as the conduit. In one embodiment, the blocking plate may be inserted in the conduit and held in place by the clamp-type coupling 50 of the original cooling system. Venting plate 70 may be any suitable flow restriction disposed in the coolant conduit that connects the exterior-facing header tanks of B-side radiators 42 and 44. Accordingly, the venting plate may be a circular plate having the same diameter as the conduit, and comprising one or more relatively small holes to allow coolant in B-side radiators 40 and 42 to drain via B-side radiator 44 when the engine is turned off. The holes may be small enough to ensure that the vast majority of coolant is forced through the B-side radiators in the illustrated "S" pattern while the engine is running. In one embodiment, the venting plate may be inserted in the conduit and held in place by clamp-type coupling 52 of the original cooling system.

Figure 3:
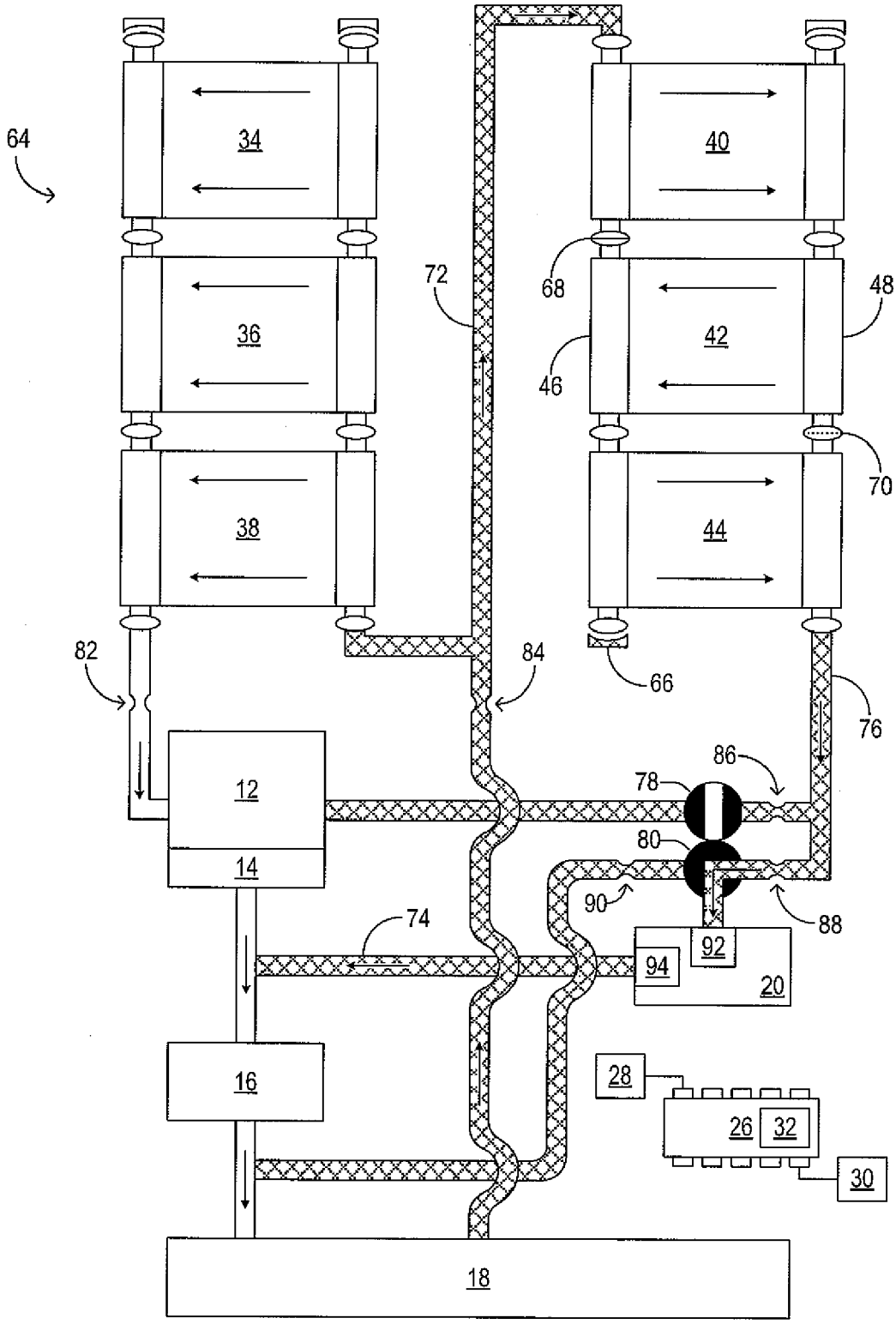
FIG. 3 shows aspects of a modified cooling system operating in a "MAT COOL" mode, in accordance with an embodiment of the present disclosure.
Figure 4:
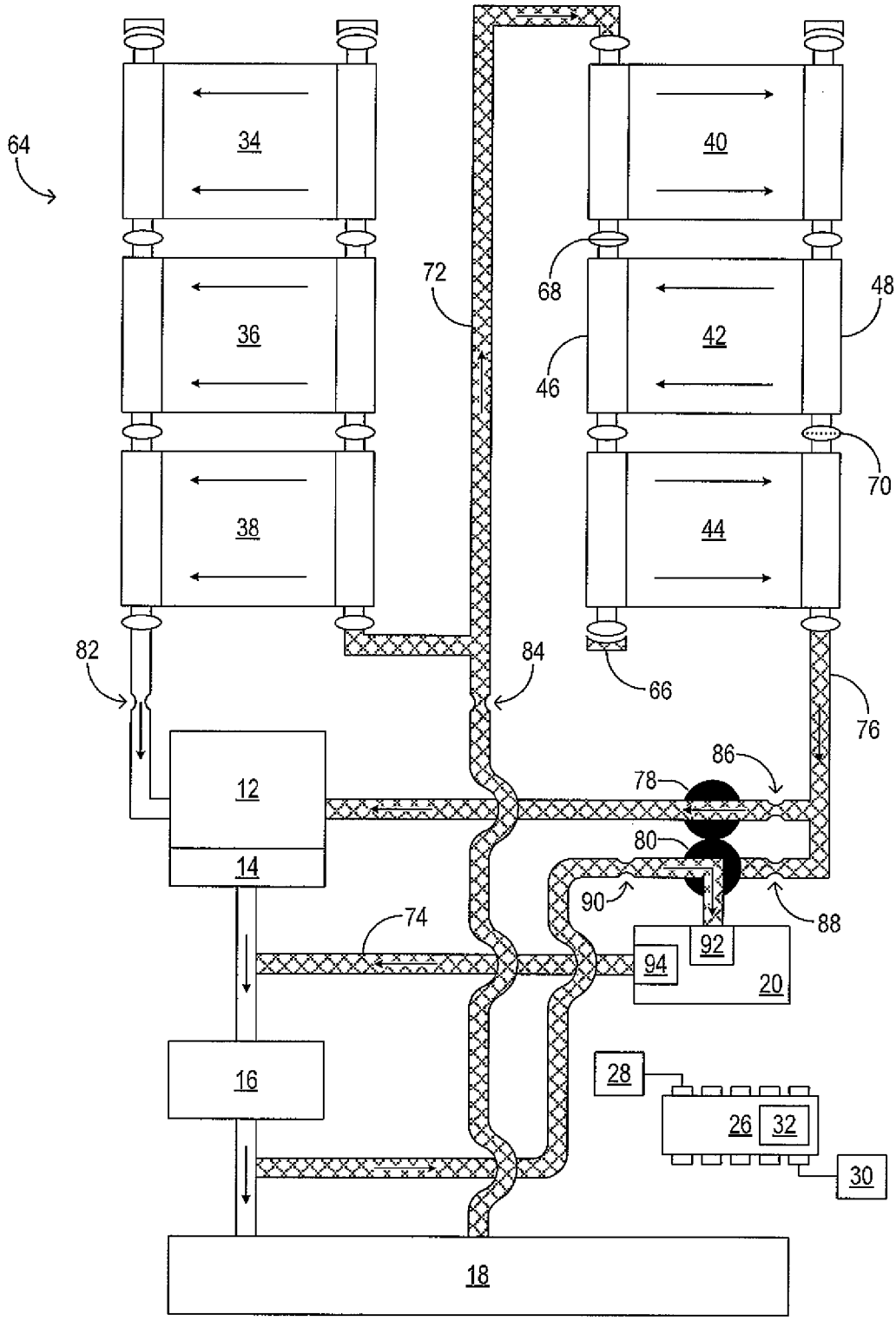
FIG. 4 shows aspects of a modified cooling system operating in an "OIL COOL" mode, in accordance with an embodiment of the present disclosure.

As shown in FIGS. 3 and 4, plumbing segment 72 couples cylinder jackets 18 to A-side radiator 38 and to B-side radiator 40; plumbing segment 74 couples an outlet of charge-air intercoolers 20 to an inlet of coolant pump 16; and plumbing segment 76 couples the exterior-facing header tank of B-side radiator 44 to flow-through coolant tank 12 and to the inlet of charge-air intercoolers 20. Plumbing segment 76 also couples the outlet of coolant pump 16 to the inlet of the charge-air intercoolers.

Plumbing segment 76 includes control valves 78 and 80. Control valves 78 and 80 are fluidically independent control valves maintained in registry with each other via a common shaft or otherwise actuated in common. For example, both valves may be controlled by valve actuator 28, operatively coupled to electronic control system 26. In one embodiment, control valve 78 may be a butterfly valve, and control valve 80 may be a T-port valve. Because the two control valves may actuate simultaneously in this embodiment, the pneumatic and/or electronic control lines used in the pre-existing system (not shown in the drawings) may be used to actuate the control valves of the modified cooling system. In another embodiment, two pneumatically controlled actuators may be used, with one actuator controlling two butterfly control valves, and a second actuator controlling a single butterfly control valve.

The positions of control valves 78 and 80 may at least partly determine whether modified cooling system 64 is operated in an "OIL COOL" mode (e.g., a second mode), which provides the most active cooling of the engine lubricant, or whether the modified cooling system is operating in "MAT COOL" mode (e.g., a first mode), which provides a lower manifold air temperature for decreased NOX emissions. In particular, the positions of the control valves may determine whether coolant flowing from the B-side radiators is delivered directly to charge-air intercoolers 20 before being pumped into cylinder jackets 18, or whether it is delivered to flow-through coolant tank 12 and lubricant cooler 14 before being provided to the charge-air intercoolers. The cooling mode enacted at any given time may be selected automatically by the electronic control system based on one or more operating conditions of the turbocharged engine system—e.g., coolant temperature, manifold air temperature, ambient temperature, engine load, as further described hereinafter.

FIGS. 3 and 4 show flow-restricting devices 82, 84, 86, 88 and 90—orifices or filters, for example—disposed within the coolant conduits of modified cooling system 64. The flow restrictions provided by the flow-restricting devices may be adjusted during the retrofit to provide suitable flow rates through the various components in "OIL COOL" mode and "MAT COOL" mode. The table below lists typical flow rates through select cooling system components in one example embodiment.

| COOLING SYSTEM COMPONENT | FLOW RATES (gallons per minute; 1 gal/min = 3.785 liters/min) "OIL COOL" MODE | "MAT COOL" MODE |
|---|---|---|
| cylinder jackets 18 | 600 | 600 |
| charge-air intercoolers 20 | 150 | 150 |
| A-side radiators 34, 36, 38 | 350 | 450 |
| B-side radiators 40, 42, 44 | 250 | 150 |
| lubricant cooler 14 | 600 | 450 |
| water coolant pump 16 | 600 | 750 |

Finally, FIGS. 3 and 4 show replacement fittings 92 and 94 coupled to charge-air intercoolers 20. The replacement fittings may be used to allow the intercooler to accept coolant from the second bank of radiators and to deliver the coolant to the inlet of the coolant pump. In original cooling system 10, for example, coolant flows out of the coolant pump 16 and goes into a front-end casting of the engine, which is bolted to the engine main frame. The front-end casting contains the coolant pump, oil pump, oil relief, and a conduit for the coolant to split and flow both to the cylinder jackets 18 and charge-air intercoolers 20. Further, an intercooler coolant inlet port is bolted and sealed to both the front-end casting and the charge-air intercoolers, and is a conduit for coolant to go from the front-end casting to the charge-air intercoolers. In modified cooling system 64, however, although the front-end casting may be the same as in original cooling system 10, the intercooler coolant inlet port is of a different design. Although it still bolts to the front-end casting and to the charge-air intercooler, it plugs the opening to the front-end casting, and further acts as a conduit between an external conduit and the charge-air intercooler.

Figure 5:
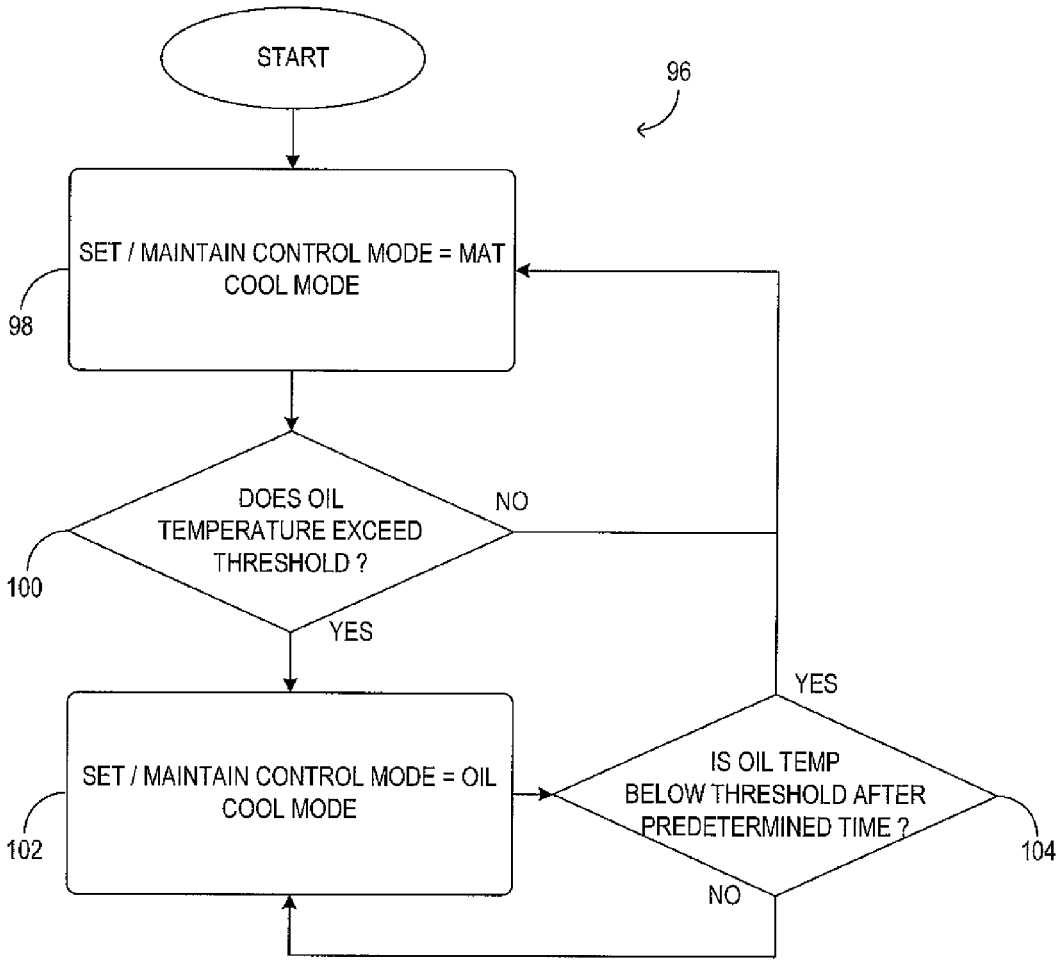
FIG. 5 illustrates aspects of a method for cooling a locomotive engine equipped with a modified cooling system, in accordance with an embodiment of the present disclosure.

FIG. 5 illustrates aspects of an example method 96 for operating a modified cooling system of a turbocharged engine system, such as modified cooling system 64. Although the method is presently described with reference to the example configurations set forth above, it may be enacted via other suitable configurations as well.

Method 96 is enacted by an electronic control system of a turbocharged engine system or of the modified cooling system installed therein, such as electronic control system 26. The method begins at 98, where the control mode of the modified cooling system is set to "MAT COOL" mode or maintained in "MAT COOL" mode. The electronic control system may set the cooling mode to "MAT COOL" mode by actuating one or more electronically and/or pneumatically actuated control valves, such as control valves 78 and 80 described hereinabove.

In "MAT COOL" mode, coolant flowing through B-side radiators 40, 42, and 44 flows through control valve 80 and directly to charge-air intercoolers 20; the coolant then advances to an inlet of coolant pump 16. Thus, the coolant flows to the charge-air intercoolers without being pre-warmed by the engine lubricant, in contrast to the action of original cooling system 10. The coolant provided to the charge-air intercoolers is therefore colder than in the original cooling system. In one embodiment, the coolant flow may be split into two flows—a first flow directed to an A-side charge-air intercooler and a second flow directed to a B-side charge-air intercooler. In one embodiment, the coolant flow through the A-side charge-air intercooler may be greater than the coolant flow through the B-side charge-air intercooler. The coolant flow may then merge into a single post-intercooler flow, and further merge with coolant from lubricant cooler 14 at the inlet of coolant pump 16. Meanwhile, coolant from the A-side radiators flows to flow-through coolant tank 12 and lubricant cooler 14, as in the original cooling system.

In "MAT COOL" mode, the temperature of the coolant flowing to charge-air intercoolers 20 is further reduced by decreasing the flow rate through B-side radiators 40, 42, and 44, while increasing the flow rate through the A-side radiators 34, 36, and 38. To avoid loss of cooling efficiency due to decreased turbulence in the B-side radiators, the coolant is confined to an 'S' shaped path. This configuration keeps the coolant velocity through the B-side radiators substantially constant and increases the effective length of the B-side radiators, for increased cooling efficiency. From the charge-air intercoolers and lubricant cooler, the coolant is pumped into cylinder jackets 18. The coolant then exits the cylinder jackets and advances to the A-side and B-side radiators. Coolant from the A-side radiators flows into flow-through coolant tank 12 and lubricant cooler 14, advances to coolant pump 16, and repeats the cycle.

Continuing in FIG. 5, method 96 advances to 100, where it is determined whether the engine lubricant temperature exceeds a threshold temperature. The determination may be made based on an output of a lubricant temperature sensor (sensor 30, for example) operatively coupled to an electronic control system of the modified cooling system. If the engine lubricant temperature does not exceed the threshold temperature, then the method returns to 98. Otherwise, the method advances to 102, where the control mode of the modified cooling system is set or maintained in "OIL COOL" mode. The electronic control system may set the cooling mode to "OIL COOL" mode by actuating one or more electrically and/or pneumatically actuated control valves, such as control valves 78 and 80 described hereinabove.

Although "MAT COOL" mode provides increased cooling of charge-air intercoolers 20 relative to original cooling system 10, it may reduce the lubricant-cooling capacity of the cooling system under conditions of high ambient temperatures and/or high load. Therefore, a complementary "OIL COOL" control mode is also provided.

In "OIL COOL" mode, coolant flowing from cylinder jackets 18 advances to the A-side and B-side radiators as in the "MAT COOL" mode. The coolant in the A-side radiators follows the same path through flow-through coolant tank 12, lubricant cooler 14, and coolant pump 16 as described above. However, the coolant in the B-side radiators is now directed through control valve 78 and into the flow-through coolant tank, where it merges with the coolant flow from the A-side radiators, and advances to the lubricant cooler and the coolant pump inlet. The combined coolant flow from the A-side and B-side radiators is then pumped into cylinder jackets 18 and charge-air intercoolers 20. In "OIL COOL" mode, the capacity of modified cooling system 64 to cool the engine lubricant is nearly that of original cooling system 10.

Continuing in FIG. 5, method 96 advances to 104, where it is determined whether the engine lubricant temperature has dropped below the threshold temperature after a suitable time interval of time has elapsed, such as 5 minutes in one, non-limiting embodiment. The determination may be made based on an output of a lubricant temperature sensor operatively coupled to the electronic control system. If the engine lubricant temperature has not dropped below the threshold temperature after the predetermined period of time, then the method returns to 102, where "OIL COOL" mode is maintained. Otherwise, the method returns to 98, where the control mode of the modified cooling system is restored to "MAT COOL" mode.

Figure 6:
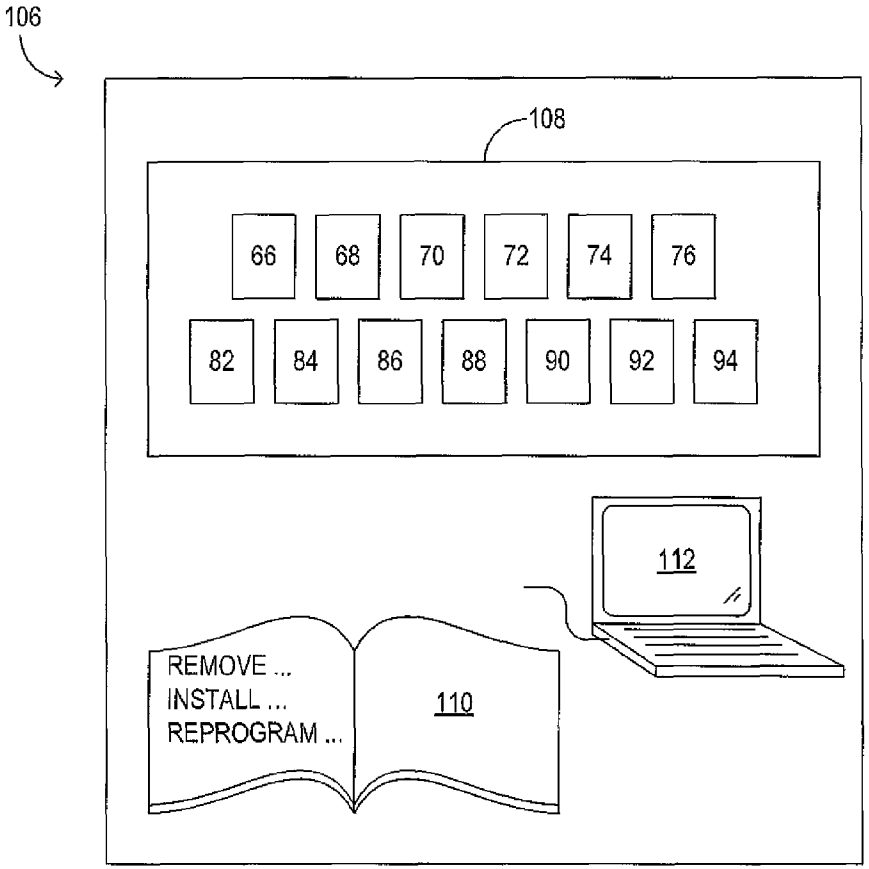
FIG. 6 schematically illustrates an example retrofit kit in accordance with an embodiment of the present disclosure.

The retrofitting approach set forth herein is now further described with reference to a retrofit kit, which may be provided for the purpose of retrofitting a cooling system of a turbocharged engine system, where the cooling system as originally configured includes first and second banks of radiators, a flow-through coolant tank coupled to a lubricant cooler, a cylinder jacket, a coolant pump, an intercooler, and a plumbing system interconnecting the first and second banks of radiators, the flow-through coolant tank, the lubricant cooler, the cylinder jacket, the coolant pump, and the intercooler. FIG. 6 schematically illustrates an example retrofit kit 106; it includes plumbing patch 108, instructional booklet 110, and reprogrammer 112.

Plumbing patch 108 may be configured to couple to one or more components of original cooling system 10. The plumbing patch includes, in one embodiment, first plumbing segment 74 configured to couple an outlet of charge-air intercoolers 20 to an inlet of coolant pump 16; second plumbing segment 72 configured to couple cylinder jackets 18 to A-side radiators 34, 36, and 38, and B-side radiators 40, 42, and 44; and third plumbing segment 76 configured to couple the B-side radiators to an inlet of the charge-air intercoolers, to flow-through coolant tank 12, and to an outlet of the coolant pump. The third plumbing segment includes control valves 78 and 80, operatively coupled to electronic control system 26, as described hereinabove.

Plumbing patch 108 includes blocking plate 68, configured for installation at an interior-facing side of B-side radiator 42, and further configured to prevent the coolant from flowing into interior-facing header tank 46. The plumbing patch also includes a venting plate 70 configured for installation at an exterior-facing side of B-side radiator 42, and further configured to divert most of a pressurized flow of coolant away from the exterior-facing header tank, but to allow the coolant to drain slowly from the exterior-facing header tank when the engine is turned off. The plumbing patch also includes end cap 66 configured to couple to a clamp-type coupling of B-side radiator 40 and to prevent the coolant from flowing out of the radiator through the clamp-type coupling. The plumbing patch also includes one or more flow-restricting devices 82, 84, 86, 88, 90, configured to restrict a flow of coolant in one or more plumbing segments of the plumbing patch. The plumbing patch also includes replacement fittings 92 and 94, configured to couple to the charge-air intercoolers 20 and to allow the charge-air intercoolers to accept coolant from the B-side radiators and to deliver the coolant to an inlet of coolant pump 16. In some embodiments, some or all component parts of the plumbing patch may be configured to couple to one or more clamp-type couplings of the original cooling system.

Continuing in FIG. 6, instructional booklet 110 includes written instructions that specify installing plumbing patch 108. In particular, the instructional booklet may specify coupling first plumbing segment 74 from an outlet of charge-air intercoolers 20 to an inlet of coolant pump 16, coupling second plumbing segment 72 from cylinder jackets 18 to the A-side and B-side radiators, and coupling third plumbing segment 76 from the B-side radiators to an inlet of the charge-air intercoolers, to flow-through coolant tank 12, and to an outlet of the coolant pump.

In some embodiments, instructional booklet 110 may further include instructions that specify removing a pre-existing plumbing section of an original cooling system. The preexisting section may include, with reference to original cooling system 10, a fourth plumbing segment 58 configured to couple B-side radiator 44 to flow-through coolant tank 12, a fifth plumbing segment 60 configured to couple an outlet of coolant pump 16 to an inlet of charge-air intercoolers 20, and a sixth plumbing segment 62 configured to couple cylinder jackets 18 to an outlet of the charge-air intercoolers, the flow-through coolant tank, and the A-side and B-side radiators, the sixth plumbing segment comprising at least one control valve 22 and/or 24. In some embodiments, the instructional booklet may specify that some or all of the pre-existing section is to be removed before the plumbing patch is installed. In other embodiments, the instructional booklet may specify that removal of the pre-existing section and installation of the plumbing patch should be coordinated, conducted at substantially the same time, and/or enacted in alternating steps.

In these and other embodiments, instructional booklet 110 may include instructions that specify coupling plumbing patch 108 to one or more clamp-type couplings of original cooling system 10. The instructions may further specify installing blocking plate 68 at an interior-facing header tank of B-side radiator 42, installing venting plate 70 at an exterior-facing header tank of B-side radiator 42, and installing end cap 66 on a clamp-type coupling of B-side radiator 44. The instructional booklet may further include instructions that specify installing flow-restricting devices 82, 84, 86, 88, and 90 in the various plumbing segments of the plumbing patch, and installing replacement fittings 92 and 94 on charge-air intercoolers 20, as described hereinabove.

In these and other embodiments, instructional booklet 110 may include instructions that specify reprogramming electronic control system 26 in a manner consistent with operating modified cooling system 64 in a "MAT COOL" mode and in an "OIL COOL" mode, as described herein.

Continuing in FIG. 6, reprogrammer 112 is a laptop computer equipped with a communications link for operative coupling to a locomotive's electronic control system. The reprogrammer may be configured to alter or rewrite at least some of the machine-readable instructions stored in a memory of the locomotive's electronic control system based on machine-readable instructions stored in the reprogrammer. In particular, the reprogrammer may be adapted to store machine-readable instructions that, when executed by electronic control system 26, cause the electronic control system to operate modified cooling system 64 in a "MAT COOL" mode when a lubricant temperature is below a threshold and in an "OIL COOL" mode when the lubricant temperature is above a threshold. In this embodiment, the plumbing system may be further configured, during "MAT COOL" mode, to direct the coolant from the B-side radiators to an inlet of charge-air intercoolers 20; and, during "OIL COOL" mode, to direct the coolant from the B-side radiators to flow-through coolant tank 12 and from an outlet of coolant pump 16 to an inlet of charge-air intercoolers 20.

It will be understood that instructional booklet 110 is but one of many contemplated forms of media that may be used to embody human-readable instructions. In other embodiments equally contemplated, the human-readable instructions may be provided on a computer text file, an audio or video file, or any other suitable media. For example, the human-readable instructions of instructional booklet 110 may be stored as PDF files on reprogrammer 112. Likewise, reprogrammer 112 is but one of many contemplated forms of media that may be used to embody machine-readable instructions. In other embodiments equally contemplated, the machine-readable instructions may be provided via flash memory, a network server, a fixed disk of an EPROM programmer, or via any other suitable media.

Figure 7:
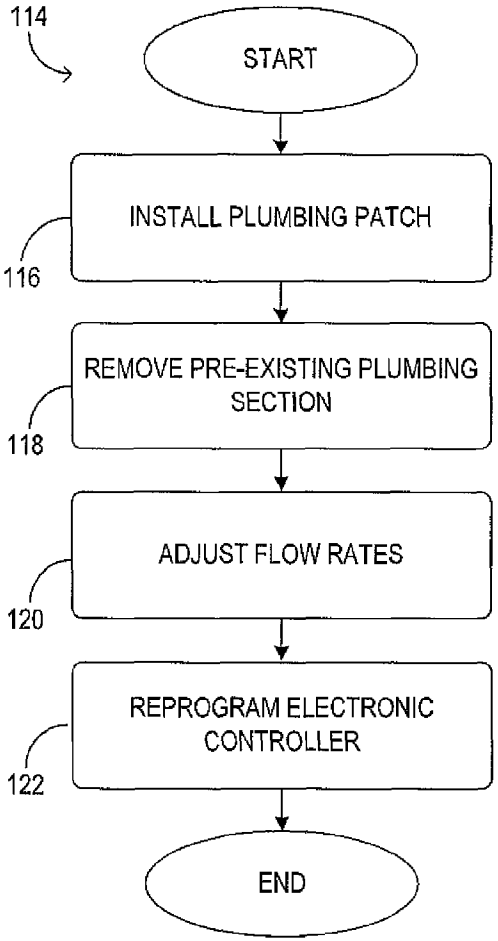
FIG. 7 illustrates an example method for retrofitting a cooling system of a turbocharged engine system, in accordance with an embodiment of the present disclosure.

FIG. 7 illustrates an example method 114 for retrofitting a cooling system of a turbocharged engine system, where the cooling system as originally configured directs at least some coolant through first and second radiators in parallel and from the first and second radiators to a lubricant cooler before flowing to an inlet of the intercooler. Such a cooling system is illustrated, by example, in FIGS. 1 and 2. The method comprises reconfiguring the cooling system so that at least some coolant flows from the first radiator to the second radiator, and from the second radiator to an inlet of the intercooler without first passing through the lubricant cooler.

Method 114 begins at 116, where plumbing patch 108 is installed in the plumbing system of the cooling system, the plumbing patch comprising: first plumbing segment 74 configured to couple an outlet of charge-air intercoolers 20 to an inlet of coolant pump 16, second plumbing segment 72 configured to couple cylinder jackets 18 to A-side radiators 34, 36, and 38, and B-side radiators 40, 42, and 44; and third plumbing segment 76 configured to couple the B-side radiators to an inlet of the charge-air intercoolers, flow-through coolant tank 12, and an outlet of the coolant pump. The third plumbing segment includes control valves 78 and 80, operatively coupled to electronic control system 26.

Method 114 advances to 118, where a pre-existing section of the plumbing system is removed, the pre-existing section comprising: a fourth plumbing segment 58 configured to couple B-side radiator 44 to flow-through coolant tank 12, a fifth plumbing segment 60 configured to couple an outlet of coolant pump 16 to an inlet of charge-air intercoolers 20, and a sixth plumbing segment 62 configured to couple cylinder jackets 18 to an outlet of the charge-air intercoolers, to the flow-through coolant tank, and to the A-side and B-side radiators. In this embodiment, the sixth plumbing segment comprises at least one control valve 22 and/or 24. In some embodiments, the pre-existing section of the plumbing system may conform to an original specification of original cooling system 10, while plumbing patch 108 may not conform to the original specification of the cooling system.

Method 114 advances to 120, where a flow rate through one or more plumbing segments in the plumbing patch is adjusted by installing flow restricting devices 82, 84, 86, 88, and 90 in the various plumbing segments of the plumbing patch, and by installing replacement fittings 92 and 94 on charge-air intercoolers 20, as described hereinabove. In some embodiments, the various flow rates may be adjusted based on the locomotive model to be retrofit, with different locomotive models requiring different adjustment. The process of adjusting the flow rates for a given locomotive model for the first time may involve monitoring various operating parameters of the locomotive, and adjusting the flow restricting devices to optimize the operating parameters. For subsequent retrofitting of locomotives of the same model, however, at least some of the settings borrowed from the first or previous time that a locomotive of the same model was retrofitted.

Method 114 then advances to 122, where instructions are programmed into memory 32 of electronic control system 26, which, when executed by the electronic control system, cause the electronic control system to operate modified cooling system 64 in a "MAT COOL" mode when a lubricant temperature is below a threshold and in an "OIL COOL" mode when the lubricant temperature is above a threshold. In this embodiment, the plumbing system may be further configured, during "MAT COOL" mode, to direct the coolant from the B-side radiators to an inlet of charge-air intercoolers 20; and, during "OIL COOL" mode, to direct the coolant from the B-side radiators to flow-through coolant tank 12 and from an outlet of coolant pump 16 to an inlet of charge-air intercoolers 20.

It will be understood that the sequence of process steps indicated in the above embodiment is provided by way of example. Other embodiments fully consistent with the present disclosure may enact substantially the same process steps, but in a different sequence. For example, in some embodiments, some or all of the pre-existing section may be removed before the plumbing patch is installed. In other embodiments, removal of the pre-existing section and installation of the plumbing patch may be coordinated, conducted at substantially the same time, and/or enacted in alternating steps. In some embodiments, one or more of the process steps illustrated herein may be repeated, and in still other embodiments, one or more of the process steps illustrated herein may be omitted.

It will further be understood that the example control and estimation routines disclosed herein may be used with various system configurations. These routines may represent one or more different processing strategies such as event-driven, interrupt-driven, multi-tasking, multi-threading, and the like. As such, the disclosed process steps (operations, functions, and/or acts) may represent code to be programmed into computer readable storage medium in an electronic control system.

Finally, it will be understood that the articles, systems and methods described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. A method for retrofitting a cooling system of a turbocharged engine system, the method comprising:

reconfiguring the cooling system, said reconfiguration converting a cooling-system flow from a first, original configuration to a second, retrofitted configuration, wherein in the first, original configuration at least some coolant flows through a first radiator and a second radiator in parallel and from the first and second radiators to a lubricant cooler before flowing to an inlet of an intercooler in the cooling system; and wherein in the second, retrofitted configuration, the at least some coolant flows from the first radiator to the second radiator in series, and from the second radiator to the inlet of the intercooler without first passing through the lubricant cooler.

2. The method of claim 1, wherein the cooling system comprises: first and second banks of radiators, a flow-through coolant tank coupled to the lubricant cooler, a cylinder jacket, a coolant pump, the intercooler, and a plumbing system interconnecting the first and second banks of radiators, the flow-through coolant tank, the lubricant cooler, the cylinder jacket, the coolant pump, and the intercooler; the method further comprising:

installing a plumbing patch in the plumbing system, the plumbing patch comprising:

a first plumbing segment configured to couple an outlet of the intercooler to an inlet of the coolant pump, a second plumbing segment configured to couple the cylinder jacket to the first and second banks of radiators, and a third plumbing segment configured to couple the second bank of radiators to an inlet of the intercooler, the flow-through coolant tank, and an outlet of the coolant pump, the third plumbing segment comprising at least one control valve operatively coupled to an electronic control system of the cooling system; and removing a pre-existing section of the plumbing system, the pre-existing section comprising:

a fourth plumbing segment configured to couple the second bank of radiators to the flow-through coolant tank, a fifth plumbing segment configured to couple an outlet of the coolant pump to an inlet of the intercooler, and a sixth plumbing segment configured to couple the cylinder jacket to an outlet of the intercooler, the flow-through coolant tank, and the first and second banks of radiators, the sixth plumbing segment comprising at least one control valve.

3. The method of claim 2, further comprising programming instructions into a non-transitory memory of the electronic control system that, when executed by the electronic control system, operate the cooling system in a first operating mode when a lubricant temperature is below a threshold and in a second operating mode when the lubricant temperature is above the threshold;

wherein the plumbing system is further configured, during the first operating mode, to direct coolant from the second bank of radiators to an inlet of the intercooler; and wherein the plumbing system is further configured, during the second operating mode, to direct coolant from the second bank of radiators to the flow-through coolant tank and from an outlet of the coolant pump to an inlet of the intercooler.

4. The method of claim 2, further comprising adjusting a flow rate through one or more plumbing segments in the plumbing patch by installing flow restrictions in the one or more plumbing segments.

5. A method for operating a modified cooling system of a turbocharged engine system, the method comprising:

operating the cooling system in a first operating mode when a lubricant temperature is below a threshold and in a second operating mode when the lubricant temperature is above the threshold, the cooling system comprising a set of components conforming to an original specification of the turbocharged engine system, the set of components comprising: first and second banks of radiators, a flow-through coolant tank coupled to a lubricant cooler, a cylinder jacket, a coolant pump, an intercooler, and a plumbing system interconnecting the first and second banks of radiators, the flow-through coolant tank, the lubricant cooler, the cylinder jacket, the coolant pump, and the intercooler;

wherein operating the cooling system in the first operating mode comprises directing coolant from the second bank of radiators to an inlet of the intercooler; and wherein operating the cooling system in the second operating mode comprises directing the coolant from the second bank of radiators to the flow-through coolant tank and from an outlet of the coolant pump to an inlet of the intercooler.

6. The method of claim 5, further comprising switching between the first and second operating modes based on a response of a temperature sensor disposed in the cooling system.

7. The method of claim 6, wherein the cooling system is operated in the second operating mode for at least a predetermined period of time before being switched back to the first operating mode based on the response of the temperature sensor.

8. The method of claim 5, further comprising blocking a flow of coolant into a first side of a radiator via a blocking plate installed at the first side of the radiator.

9. The method of claim 8, further comprising draining the radiator through a venting plate installed at a second side of the radiator, opposite the first side, when the cooling system is shut down.

10. The method of claim 5, further comprising directing at least some coolant from a first radiator to a second radiator, and from the second radiator to the intercooler without first passing through the lubricant cooler.

11. A kit for retrofitting a turbocharged engine system having a cooling system, the cooling system including first and second banks of radiators, a flow-through coolant tank coupled to a lubricant cooler, a cylinder jacket, a coolant pump, an intercooler, and a plumbing system interconnecting the first and second banks of radiators, the flow-through coolant tank, the lubricant cooler, the cylinder jacket, the coolant pump, and the intercooler, the kit comprising:

a plumbing patch configured to couple to the cooling system, the plumbing patch comprising:

a first plumbing segment configured to couple an outlet of the intercooler to an inlet of the coolant pump, a second plumbing segment configured to couple the cylinder jacket to the first and second banks of radiators, and a third plumbing segment configured to couple the second bank of radiators to an inlet of the intercooler, to the flow-through coolant tank, and to an outlet of the coolant pump, the third plumbing segment comprising at least one control valve configured to be operatively coupled to an electronic control system; and human-readable media with plumbing patch installation instructions that specify how to install the plumbing patch.

12. The kit of claim 11, wherein the plumbing patch installation instructions specify:

removing a pre-existing section of the plumbing system, the pre-existing section comprising:

a fourth plumbing segment configured to couple the second bank of radiators to the flow-through coolant tank, a fifth plumbing segment configured to couple an outlet of the coolant pump to an inlet of the intercooler, and a sixth plumbing segment configured to couple the cylinder jacket to an outlet of the intercooler, the flow-through coolant tank and the first and second banks of radiators, the sixth plumbing segment comprising at least one control valve;

coupling the first plumbing segment from an outlet of the intercooler to the inlet of the coolant pump;

coupling the second plumbing segment from the cylinder jacket to the first and second banks of radiators;

coupling the third plumbing segment from the second bank of radiators to an inlet of the intercooler, the flow-through coolant tank, and the outlet of the coolant pump; and reprogramming the electronic control system.

13. The kit of claim 12, further comprising non-transitory, machine-readable media embodying instructions that, when executed by the electronic control system, cause the electronic control system to:

operate the cooling system in a first operating mode when a lubricant temperature is below a threshold and in a second operating mode when the lubricant temperature is above the threshold;

wherein the plumbing system is further configured, during the first operating mode, to direct coolant from the second bank of radiators to the intercooler; and wherein the plumbing system is further configured, during the second operating mode, to direct the coolant from the second bank of radiators to the flow-through coolant tank and from an outlet of the coolant pump to an inlet of the intercooler.

14. The kit of claim 11, further comprising:

a blocking plate configured for installation at a first side of a radiator of the second bank of radiators, and further configured to prevent coolant from flowing into the first side of the radiator;

wherein the plumbing patch installation instructions further specify installing the blocking plate at the first side of the radiator.

15. The kit of claim 11, further comprising:

a venting plate configured for installation at a second side of a radiator of the second bank of radiators, and further configured to divert a majority of a pressurized flow of coolant away from the second side of the radiator, but to allow the coolant to drain from the second side of the radiator;

wherein the plumbing patch installation instructions further specify installing the venting plate at the second side of the radiator.

16. The kit of claim 11, further comprising:

an end cap configured to couple to a fitting on a radiator of the second bank of radiators and to prevent coolant from flowing out of the radiator through a coupling of the radiator;

wherein the plumbing patch installation instructions further specify installing the end cap on the fitting on the radiator.

17. The kit of claim 11, wherein the plumbing patch further comprises one or more flow-restricting devices configured to restrict a flow of coolant in one or more plumbing segments of the plumbing patch; and wherein the plumbing patch installation instructions further specify installing the one or more flow-restricting devices in the one or more plumbing segments.

18. The kit of claim 11, further comprising one or more replacement fittings configured to couple to the intercooler and to allow the intercooler to accept coolant from the second bank of radiators and to deliver the coolant to the inlet of the coolant pump;

wherein the plumbing patch installation instructions further specify installing the one or more replacement fittings on the intercooler.

19. The kit of claim 11, wherein the plumbing patch is configured to couple to one or more couplings of the cooling system; and wherein the plumbing patch installation instructions further specify coupling the plumbing patch to the one or more clamp-type couplings.

20. The kit of claim 11, wherein the human-readable media instructs:

coupling an outlet of the intercooler to an inlet of the coolant pump with the first plumbing segment, coupling the cylinder jacket to the first and second banks of radiators with the second plumbing segment, and coupling the second bank of radiators to an inlet of the intercooler, to the flow-through coolant tank, and to an outlet of the coolant pump, with the third plumbing segment.

* * * * *